United States Patent [19]

Melander

[11] 4,183,101

[45] Jan. 15, 1980

[54] REPLACEABLE VISOR

[75] Inventor: Clarence Melander, Newark, Del.

[73] Assignee: East Wind Industries, Inc., Dover, Del.

[21] Appl. No.: 907,480

[22] Filed: May 19, 1978

[51] Int. Cl.[2] ..... A62B 17/04

[52] U.S. Cl. ..... 2/424; 2/10; 2/205; 128/142.7

[58] Field of Search ..... 2/205, 10, 4, 6, 9, 2/423, 424; 128/142.7

[56] References Cited

U.S. PATENT DOCUMENTS

| | | | |
|---|---|---|---|
| 2,641,768 | 6/1953 | Pipher | 2/205 |
| 3,005,203 | 10/1961 | Aileo | 2/423 |
| 3,582,989 | 6/1971 | Fassbender | 2/4 |

FOREIGN PATENT DOCUMENTS

| | | | |
|---|---|---|---|
| 3268 | 10/1900 | Fed. Rep. of Germany | 2/4 |

*Primary Examiner*—Peter P. Nerbun
*Attorney, Agent, or Firm*—John J. Kane; Frederick A. Zoda; Albert Sperry

[57] ABSTRACT

A replaceable visor which is particularly usable with the headgear of a protective garment which includes a transparent member held in place by the protective garment in front of the eyes of the wearer, the transparent member including an inner and outer frame member secured to the inner and outer side of the peripheral edge thereof to define therebetween a retaining channel to receive a bead which is fixedly secured to the hole in the garment designed to receive the visor, the bead may be formed by a cord which is secured to the periphery of the hole in the garment headgear and as such provides the bead which the retaining channel may grip to hold the replaceable visor in position, the bead may be attached to the protective material by a beading pocket formed by sewing of opposite width-wise edges of a binding tape to the edge of the protective material and holding the beading cord therein, holding of the beading within the retaining channel may be facilitated by including a retaining clip which biases the beading pocket or the protective material against the inner beading pocket or the protective material against the inner frame member and as such provides limited clearance between the inwardly extending edge of the retaining clip and the inner frame member to prevent movement of the beading therepast.

11 Claims, 4 Drawing Figures

REPLACEABLE VISOR

BACKGROUND OF THE INVENTION

1. Field of the Invention

With the increased usages of protective garments in hazardous environments, it has become necessary to provide means for replacing the transparent viewing openings in these suits. In most hazardous environments industrial and governmental requirements make it necessary to completely cover a person's body and protect his skin from contact with the dangerous substance. Such garments include headgear with large viewing areas. Since these viewing areas must be quite wide the excessive weight of glass prevents its use in this application. Therefore such headgear most usually adopt transparent plastics such as plexiglass in these applications.

The advantage in the lightweight characteristics of plastic visors must be balanced against the problem of excessive scratching whenever a plastic transparent material replaces a glass transparent material. Therefore the problem arises with respect to continual replacement of such visors.

Heretofore often the entire frontal area of the headgear of a protective garment was discarded and replaced, whereas with the present invention a convenient and efficient means is provided to replace only the transparent viewing material without otherwise affecting the headgear of the protective garment.

2. Description of the Prior Art

The following U.S. patents are noted to be of interest with respect to such visors within the field of the present invention: U.S. Pat. Nos. 2,677,824; 2,773,260; 3,056,140; 3,444,561; 3,505,680; 3,533,686. These patents do not suggest the concept of easy detachable securement of a replaceable transparent visor as in the present invention.

Designs to provide replaceable visors in the prior art have utilized a plurality of complicated interconnections such as hinges and clips and so forth however none of the devices provides the simplicity and one-step replacement method as is evident in the present design.

SUMMARY OF THE INVENTION

The present invention provides a replaceable visor which finds particular usage with protective garments worn in hazardous industrial environments. The visor construction includes a transparent member which is adapted to be held in place by the surrounding protective garment in front of the eyes of the wearer. The transparent member is fixedly secured to an inner frame member which extends laterally outward peripherally from the outer rearward edge of the transparent member. In this manner the inner frame member provides an inside collar which extends outward from the viewing area of the transparent member.

Similarly the outer frame member is fixedly secured to the outwardly facing edge of the transparent member and extends laterally outward peripherally therefrom. In this manner the outer frame member in cooperation with the inner frame member and the outer edge of the transparent member defines a retaining channel circumferentially of the transparent member which is adapted to receive therein the edge of the hole in the protective garment to which the transparent member will be secured.

To facilitate gripping of the edge of the hole in the protective garment a beading means is fixedly secured thereto and is adapted to be retained within the retaining channel to thereby hold the protective garment peripherally adjacent to the replaceable visor. The beading means preferably includes a binding tape which extends longitudinally around the edge of the opening of the protective garment and is secured therealong at opposite lateral sides to opposite sides of the edges of the protective garment to form a beading pocket. This beading pocket provides the location for holding a cord means which itself provides the bead width which is desirable to facilitate gripping of the bead means and consequently gripping of the protective garment within the retaining channel.

Preferably the binding tape is stitched along the protective garment such that a single stitch may go in one side of the binding tape, go through the protective material, and then through the other side of the binding tape and thereby provide a single unitary stitched securement means between the beading pocket and the protective garment.

The cord means may include a tie means at one point therealong. This tie means will be at the location where the cord is severed, and by tightening or loosening of the cords at the tying location, the amount of inwardly extending bias exerted by the cord and, consequently, by the bead into the retaining channel can be closely controlled. Alternatively, the cord means can be of an elastic material to facilitate stretching for placement within the retaining channel of the visor during replacement thereof. Also the cord could be of a nylon material to be stretched slightly during placement.

The preferred structure includes an inner frame member which extends laterally outward peripherally away from the transparent member to a greater dimension than the outer frame member and thereby provides a backing surface for the protective material for a significant distance away laterally from the transparent viewing area.

Also the increased lateral dimension of the inner frame member provides a surface against which a retaining clip can bind the beading in place. More particularly, a retaining clip may be detachably securable to the visor and may include an inwardly extending edge which urges the bead or the protective material rearwardly. In this configuration the inwardly extending edge will attempt to be in contact with the inner frame member and, as such, will bind the bead in location within the retaining channel.

Preferably the transparent member and the inner and outer frame members may be secured together as a single construction by rivets or other similar securement means. Also preferred configurations include the beading means to be formed of the same protective material as the headgear, and, the transparent member to be of a plexiglass or other similar plastic material.

It is an object of the present invention to provide a visor which is quickly and conveniently replaceable.

It is an object of the present invention to provide a visor which includes a transparent member of plastic material.

It is an object of the present invention to provide a visor which is particularly usable with a protective garment.

It is an object of the present invention to provide a replacement visor which includes an inner and outer frame for defining a retaining channel about the periphery of the visor.

It is an object of the present invention to provide a replaceable visor assembly which includes a tension adjusting means by varying the cord-like beading member.

It is an object of the present invention to provide a visor including an elastic beading adapted to be peripherally held around the outer edge of the transparent member.

It is an object of the present invention to provide a replaceable visor which is of minimal cost to allow frequent replacement thereof.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
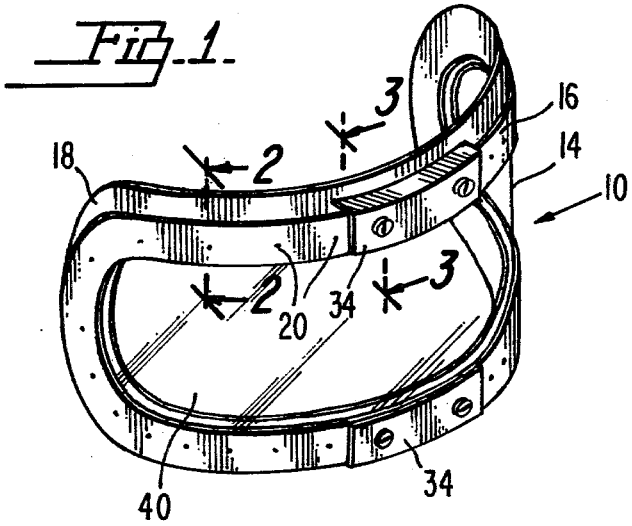
FIG. 1 is a prospective view showing the preferred embodiment of the replaceable visor of the present invention.

The present invention provides a replaceable visor 10 which is particularly adaptable for use with headgear 12 of a protective garment worn by an individual in a hazardous industrial environment.

The visor construction includes a transparent member 14 which can be made of any clear material but plastic is the most desirable. The transparent member 14 preferably is of arcuate horizontal cross-section and includes a peripheral outer edge 15. An outer frame member 16 is secured to the outer corner of outer edge 15 and extends laterally outward peripherally therefrom. Similarly an inner frame member 18 is secured adjacent the inner corner of the outer transparent edge 15. This inner frame member is fixedly secured to the inwardly facing edge of the transparent member and extends laterally outward peripherally therefrom.

The inner side of outer frame member 16 and the outer side of inner frame member 18 cooperate with the outer edge 15 of transparent member 14 to define a retaining channel 17. This channel is useful to secure the edges of protective material 22 therein. The protective material which forms the headgear 12 of the protective garment will have a hole or similar aperture therein to which the transparent member 14 is secured. The edges of this hole of material must be provided with a means for enhancing securement between the outer edge of the transparent member 15 and the protective material 22.

Figure 2:
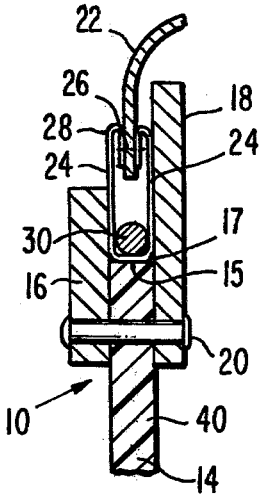
FIG. 2 is a cross-sectional view of FIG. 1 along lines 2—2.
Figure 3:
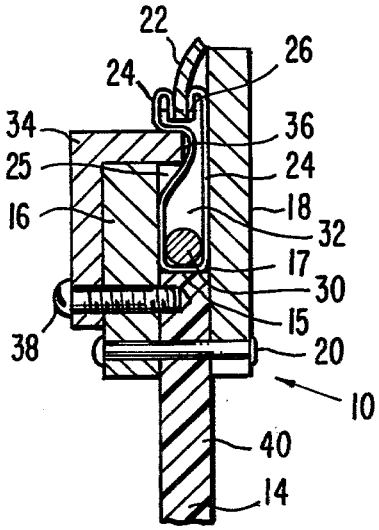
FIG. 3 is a cross-sectional view of FIG. 1 along lines 3—3.

To facilitate holding of the protective material 22 within the retaining channel 17 a beading means 28 should be formed at the edges of the hole in the headgear 12. Beading means 28 is configured fixedly secured to the protective garment and holds the protective garment peripherally adjacent to the replaceable visor. The beading means 28 should include a binding tape extending longitudinally around the edges of the hole of the protective garment. Preferably the binding tape 24 will be sewn or otherwise secured to the edge of the protective material. Basically the binding edge can be sewn along opposite lateral sides of the edge of the hole of the protective garment and as such will form a beading pocket 32. As shown in FIGS. 2 and 3 this beading pocket is achieved by the securement of the beading stitching 26 along the upper edge thereof.

The beading means 28 preferably includes a cord means 30 extending therealong particularly through the beading pocket 32 in order to provide an additional width and thereby provide the actual beading means 28.

To further secure the beading means 28 within the retaining channel 17 a retaining clip 34 can be held by detachable securement means 38 into firm abutment with the protective material 22 or the binding tape 24. Clip 34 should include an inwardly extending edge 36. Edge 36 should extend inwardly across the top of outer frame member 16 and across the top of retaining channel 17. Then the inwardly extending edge 24 will bias the protective material of the garment or the protective material being used as the binding tape 24 and crush it against the outward face of inner frame member 18. In this manner the space between the edge 24 and the inner frame member 18 will be narrower than the diameter of the cord means 30 within the beading pocket 32. As such, the slippage or movement of the protective garment out of the retaining channel 17 will be prevented unless the detachable securement means 38 is detached and the clip 34 is withdrawn.

The visor 10 of the present invention should preferably be made of a plexiglass material 40 in order to minimize weight and decrease replacement costs thereof.

Figure 4:
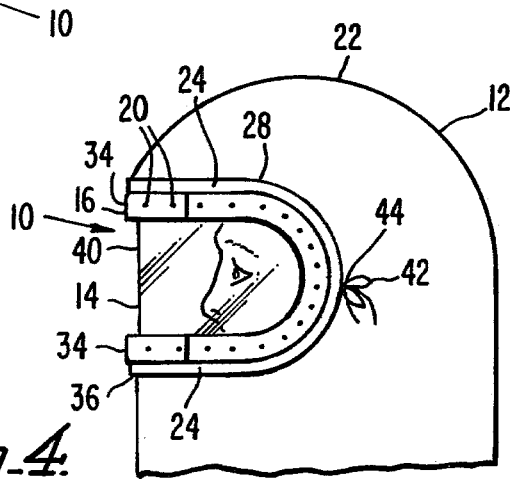
FIG. 4 is a prospective view of an embodiment of the present invention showing the visor in place within the headgear of a protective garment.

An alternative means of assuring firm attachment of the beading means 28 within the retaining channel 17 would be to make use of a tie means 42 which essentially comprises a knotting or other similar arrangement 44 such that the amount of inwardly direct tension of the cord means 30 against the outer edge 15 of transparent member 14 can be closely controlled. Although in FIG. 4 this tie means 42 is shown on the exterior of the headgear 12, it is optional and aesthetically preferable to place this tie means internally. If an external tie means 42 is used it will be necessary to provide an opening in the walls of beading pocket 32 to allow the cord ends to protrude externally for tying.

To assure firm securement between the overall structure of the transparent member 14 and the inner and outer frame members 18 and 16, respectively, a further attachment means such as rivets 20 may be utilized to maintain the orientation between these three parts. In this manner the overall dimension and physical construction of the retaining channel 17 will be maintained to facilitate the interlocking between the retaining channel 17 and the protective material 22 of the headgear 12.

It is also possible to utilize a cord means 30 formed of an elastic or other similar resilient material which allows the beading to be stretched to fit over the outer dimension of the visor 10 and allow the configuration of the binding tape 24 including the beading pocket 32 and the resilient cord means 30 to grip the transparent member 14 about the outer edge 15 thereof. In this manner a firm, quick attachment means can be provided by the present invention to facilitate easy replacement and minimize cost.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A replaceable visor, being particularly usable with a protective garment, which comprises:

(a) a transparent member held in place by the protective garment approximately in front of the eyes of the wearer;

(b) an inner frame member being fixedly secured to the inwardly facing edge of said transparent member and extending laterally outward peripherally therefrom;

(c) an outer frame member having fixedly secured to the outwardly facing edge of said transparent member and extending laterally outward peripherally therefrom to define a retaining channel in cooperation with said inner frame member circumferentially around the outer edge of said transparent member; and (d) beading means being fixedly secured to the protective garment and adapted to be retained within said retaining channel to hold the protective garment peripherally adjacent to the replaceable visor, said beading means including:

(1) a binding tape extending longitudinally around the edge of the protective garment around said transparent member and secured therealong at opposite lateral sides to opposite sides of the edges of the protective garment to form a beading pocket;

(2) a cord means held within said beading pocket to form the bead to facilitate retaining of said bead means within said retaining channel; and (e) a retaining clip being detachably secureable to the visor to hold said beading means within said retaining channel, said retaining clip including an inwardly extending edge disposed in close spaced relation with respect to said inner frame member to prevent withdrawal of said beading member therepast.

2. The visor as defined in claim 1 wherein said binding tape is stitched along the protective garment along the opposite lateral side thereof to form said beading pocket.

3. The visor as defined in claim 1 wherein said cord includes a tie means at a point therealong to allow tightening and loosening of said bead means within said retaining channel during replacement of a visor.

4. The visor as defined in claim 1 wherein said cord is of an elastic material to allow tightening and loosening of said beading means within said retaining channel during replacement of a visor.

5. The visor as defined in claim 1 wherein said cord is nylon.

6. The visor as defined in claim 1 wherein said transparent member is plexiglass.

7. The visor as defined in claim 1 wherein said inner frame member extends laterally outward peripherally more than said outer frame member.

8. The visor as defined in claim 1 wherein said inner frame member and said outer frame member are secured to said transparent member by rivets.

9. The visor as defined in claim 1 wherein said binding tape is formed of the same protective material as the protective garment.

10. A replaceable visor, being particularly usable with a protective garment, which comprises:

(a) a transparent plastic member held in place by the protective garment in front of the eyes of the wearer;

(b) an inner frame member being fixedly secured to the inwardly facing edge of said transparent member and extending laterally outward peripherally therefrom;

(c) an outer frame member being fixedly secured to the outwardly facing edge of said transparent member and extending laterally outward peripherally therefrom to define a retaining channel in cooperation with said inner frame member circumferentially around the outer edge of said transparent member, said inner frame member extending laterally outward peripherally further than said outer frame member;

(d) beading means being fixedly secured to the protective garment and adapted to be retained within said retaining channel to hold the protective garment peripherally adjacent to the replaceable visor, said beading means including:

(1) a binding tape of the same protective material as the garment extending longitudinally around the edge of the protective garment around said transparent member and sewn therealong at opposite lateral sides to opposite sides of the edges of the protective garment to form a beading pocket; and (2) a nylon cord means held within said beading pocket to form the bead width to facilitate retaining of the bead means within said retaining channel; and (e) at least one retaining clip being detachably securable to the visor to hold said beading means within said retaining channel, said retaining clip including an inwardly extending edge disposed in close spaced relation with respect to said inner frame member to prevent withdrawal of said beading member therepast.

11. The visor as defined in claim 10 wherein said transparent member is arcuate in horizontal cross-section to conform to a conventional helmet structure of a protective headgear.

* * * * *